US011175061B2

(12) United States Patent
Samuni et al.

(10) Patent No.: US 11,175,061 B2
(45) **Date of Patent: *Nov. 16, 2021**

(54) METHODS AND SYSTEMS FOR HVAC INEFFICIENCY PREDICTION

(71) Applicant: GRID4C, Tel-Aviv (IL)

(72) Inventors: Eran Samuni, Giv'atayim (IL); Eran Cohen, Ramat Gan (IL); Alexander Zak, Jerusalem (IL); Noa Rimini, Ra'anana (IL)

(73) Assignee: GRID4C, Tel-Aviv (IL)

( * ) Notice: Subject to any disclaimer, the term of this patent is extended or adjusted under 35 U.S.C. 154(b) by 73 days.

This patent is subject to a terminal disclaimer.

(21) Appl. No.: 16/619,604

(22) PCT Filed: Jun. 5, 2018

(86) PCT No.: PCT/IL2018/050611

§ 371 (c)(1),
(2) Date: Dec. 5, 2019

(87) PCT Pub. No.: WO2018/225064

PCT Pub. Date: Dec. 13, 2018

(65) Prior Publication Data

US 2020/0132327 A1 Apr. 30, 2020

Related U.S. Application Data

(60) Provisional application No. 62/515,116, filed on Jun. 5, 2017.

(51) Int. Cl.
*F24F 11/00* (2018.01)
*F24F 11/52* (2018.01)
(Continued)

(52) U.S. Cl.
CPC ..... *F24F 11/52* (2018.01); *F24F 11/49* (2018.01); *G06Q 50/06* (2013.01); *F24F 11/47* (2018.01); *F24F 2140/60* (2018.01)

(58) Field of Classification Search
CPC .. F24F 11/46; F24F 11/47; F24F 11/49; F24F 11/52; F24F 11/63; F24F 2120/00;
(Continued)

(56) References Cited

U.S. PATENT DOCUMENTS

2014/0074730 A1 3/2014 Arensmeier et al.
2014/0281645 A1* 9/2014 Sen ..... G06Q 50/06 713/340

(Continued)

FOREIGN PATENT DOCUMENTS

CA 2977483 A1 9/2016

OTHER PUBLICATIONS

International Search report dated Oct. 2, 2018. 3 pages.
Office Action for corresponding Canadian application No. 3,066,206 dated Apr. 7, 2021.

*Primary Examiner* — Jonathan Bradford
(74) *Attorney, Agent, or Firm* — Browdy and Neimark, P.L.L.C.

(57) ABSTRACT

Systems and methods are provided for predicting inefficient HVAC operation, by obtaining first training data for HVACs in a training set of households during a first period of moderate weather; obtaining second training data for HVACs in the training set of households during a subsequent period of harsher weather; generating classification labels of the household locations of the training set according to the second training data; applying the first training data and the classification labels to train a supervised machine learning algorithm, to generate an HVAC classification model predictive of inefficiency during periods of harsher weather conditions; obtaining operational data pertaining to HVACs
(Continued)

in an operational set of households during a second period of moderate weather; and applying the HVAC classification model to predict inefficiency of HVACs at individual households in the operational set during a second subsequent period of harsher weather.

14 Claims, 9 Drawing Sheets

(51) Int. Cl.

| | |
|---|---|
| ***F24F 11/49*** | (2018.01) |
| ***G06Q 50/06*** | (2012.01) |
| *F24F 140/60* | (2018.01) |
| *F24F 11/47* | (2018.01) |

(58) Field of Classification Search
CPC ..... F24F 2120/10; F24F 2120/20; F24F 2130/10; F24F 2140/60; G06Q 50/06
See application file for complete search history.

(56) References Cited

U.S. PATENT DOCUMENTS

| | | | |
|---|---|---|---|
| 2015/0057810 | A1 | 2/2015 | Smith et al. |
| 2016/0005015 | A1 | 1/2016 | Curtis |
| 2016/0246269 | A1 | 8/2016 | Ahmed |

* cited by examiner

METHODS AND SYSTEMS FOR HVAC INEFFICIENCY PREDICTION

FIELD OF THE INVENTION

The invention generally relates to the field of monitoring devices, in particular electronic appliances.

BACKGROUND

Inefficiency of electrical appliances in general and of heating, ventilation, and air conditioning (HVAC) systems in particular is a main cause for energy waste and unnecessary expenditure. Some methods for identifying needed HVAC maintenance rely on HVAC systems to provide self-test output. This HVAC feature is generally available only on industrial systems, meaning that determining inefficient operation, is typically unavailable for a residential application and is only detected when an HVAC fails to perform satisfactorily in harsh weather. A residential method for identifying HVAC maintenance needs could reduce home owner costs and discomfort.

SUMMARY

The detection of potential HVAC inefficiency in periods of moderate (i.e., "mild") weather, is acquired to predict inefficiency and potential breakdown during subsequent periods of harsher weather. More specifically, operation during spring months is acquired to predict inadequate operation during the summer, and, similarly, operation during autumn months is analyzed to predict inadequate operation during the winter. Such prediction permits advance planning of maintenance, enabling the users, particular homeowners, to repair inefficient or malfunctioning HVACs before peak mid-summer or mid-winter operation, when repair services are less available and more costly.

Embodiments of the present invention provide methods of predicting inefficient HVAC operation by performing the steps of: obtaining first training data for HVACs in a training set of households during a first period of moderate weather; obtaining second training data for HVACs in the training set of households during a subsequent period of harsher weather; generating classification labels of the household locations of the training set according to the second training data; applying the first training data and the classification labels to train a supervised machine learning algorithm, to generate an HVAC classification model predictive of inefficiency during periods of harsher weather conditions; obtaining operational data pertaining to HVACs in an operational set of households during a second period of moderate weather; and applying the HVAC classification model to predict inefficiency of HVACs at individual households in the operational set during a second subsequent period of harsher weather.

In some embodiments, the first, second, and operational data include: smart meter readings of overall household electricity consumption, readings of HVAC activation time, readings of HVAC thermostat settings, readings of indoor temperatures, and readings of outdoor temperature. The first, second, and operational data may also include at least one additional type of data from a set of data types including: HVAC mode of operation readings, HVAC physical properties, household profile parameters, and resident profile parameters.

The HVAC mode of operation may be one of cooling or heating. The HVAC physical properties may include one or more of make, model, nominal power consumption, and rated efficiency. The household profile parameters may include at least one of: house type, size, age, geographic location, regional climate, orientation and level. The resident profile parameters may include at least one of: number of residents, relationship of residents, and hours during which they occupy the residence.

The first and second training data may indicate a percentage of HVAC operating time that a thermostat setting temperature is not reached. Applying the HVAC classification model may further comprise generating a prediction of whether the inefficiency is due to HVAC malfunction, faulty maintenance, extreme thermostat settings, poor insulation, or poor sizing. Applying the HVAC classification model may further comprise generating an alert when the model predicts an HVAC inefficiency.

Training the supervised machine learning algorithm may comprise preprocessing the first and second training data to generate derived parameters from each respective type of data, wherein the derived parameters include one or more of a "household efficiency score", an "HVAC linear coefficient", and a "breakpoint temperature difference".

In some embodiments the HVAC classification model may blend, by a weighted average, a convolutional neural network along with a gradient boosted decision tree classifier.

The first period of moderate weather may be a first spring period of multiple days, such that the subsequent period of harsher weather is a first summer period of multiple days, the second period of moderate weather is a second spring period of multiple days, and the HVAC classification model predicts from operational data acquired during the second spring period an inability to efficiently cool a household during a summer immediately following the second spring period.

Alternatively, the first period of moderate weather may be a first fall period of multiple days, such that the subsequent period of harsher weather is a first winter period of multiple days, the second period of moderate weather is a second fall period of multiple days, and the HVAC classification model predicts from operational data acquired during the second fall period an inability to efficiently warm a household during a winter immediately following the second spring period.

BRIEF DESCRIPTION OF DRAWINGS

For a better understanding of various embodiments of the invention and to show how the same may be carried into effect, reference will now be made, purely by way of example, to the accompanying drawings in which like numerals designate corresponding elements or sections throughout. Figures are presented in what is believed to be the most useful and readily understood form for the description of the principles and conceptual aspects of the invention. In this regard, no attempt is made to show structural details of the invention in more detail than is necessary for a fundamental understanding of the invention, the description, taken with the drawings, making apparent to those skilled in the art how the several forms of the invention may be embodied in practice. In the accompanying drawings.

DETAILED DESCRIPTION

Figure 1:
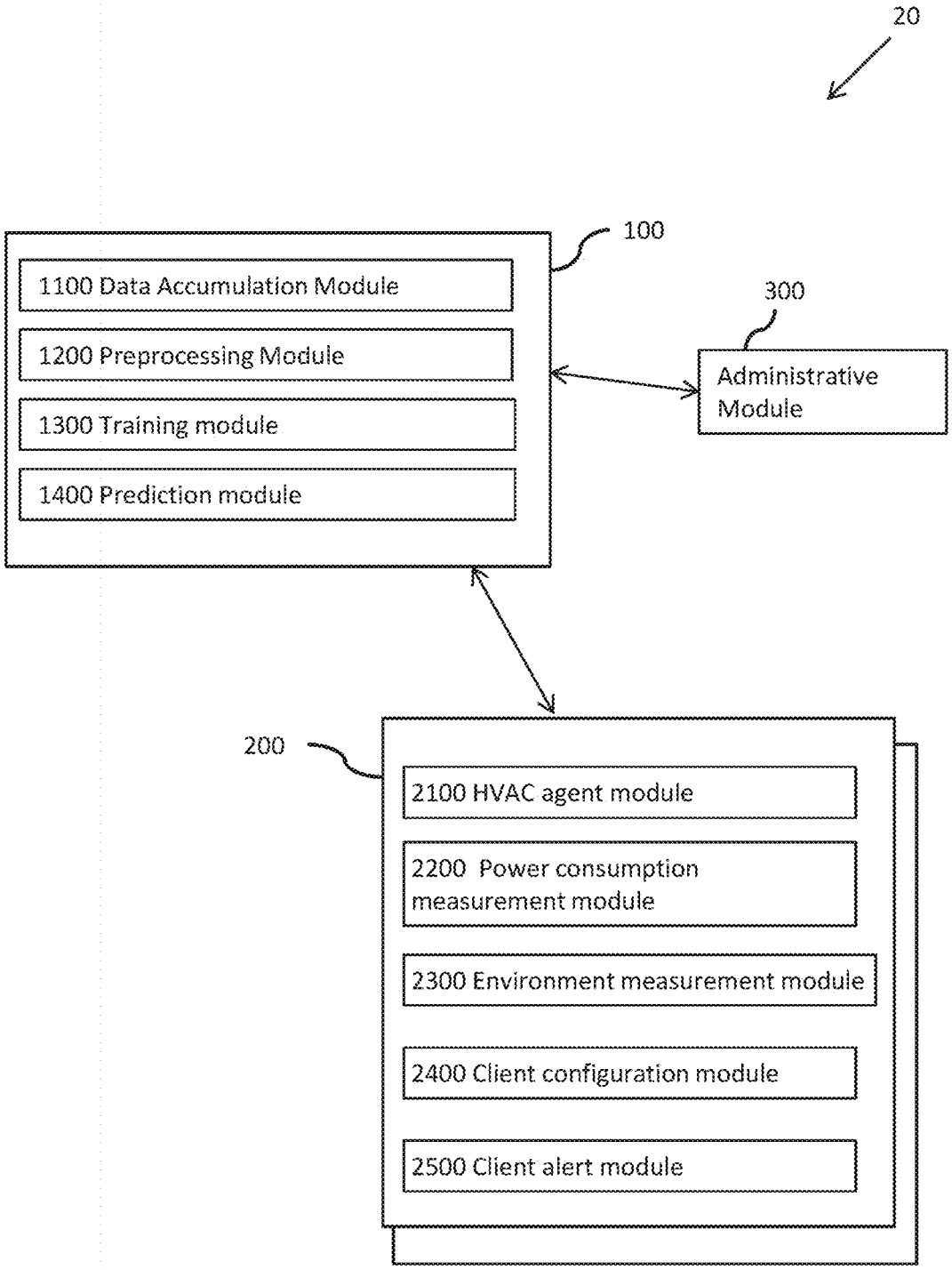
FIG. 1 is a block diagram depicting a system including client modules for collecting data pertaining to specific households and HVAC systems, and for propagating this data to a server, according to some embodiments of the present invention.

It is to be understood that the invention is not limited in its application to the details of construction and the arrangement of the components set forth in the following description or illustrated in the drawings, but is applicable to other embodiments that may be practiced or carried out in various ways. Furthermore, it is to be understood that the phraseology and terminology employed herein is for the purpose of description and should not be regarded as limiting.

The following is a table of definitions of the terms used throughout this application.

| Term | Definition |
|---|---|
| Server module | A module implemented in software or hardware or any combination thereof, consisting of all sub modules required for:<br>accumulating data pertinent to a plurality of households and HVAC systems installed therein;<br>producing predictions of specific HVAC malfunction or inefficiency; and<br>providing alerts based on predicted HVAC malfunction or inefficiency. |
| Household client modules | Modules implemented in software or hardware or any combination thereof, configured to interface with the server module and to transmit data pertaining to a specific household's HVAC system operation. |
| Household profile parameters | A set of parameters relating to each household, including, for example, at least one of: house type (e.g. flat, duplex house etc.), size (area and volume), age, geographic location, regional climate, level (e.g. top story, bottom floor), and orientation (south-bound, north-bound, etc.). |
| Resident profile parameters | A set of parameters relating to the residents of each household, including for example at least one of: number of residents, relationship of residents (e.g. family, married couple, roommates), lifestyle parameter (e.g., hours in which they occupy the residence), etc. |
| Training household group | A group of households for which an HVAC classification model is trained during a period of moderate weather. Households within the training group provide data that includes one or more of the following data types:<br>Household profile parameters;<br>Residents profile parameters;<br>Indoor temperature;<br>Outdoor temperature;<br>HVAC thermostat settings;<br>HVAC work mode;<br>HVAC compressor activation time; and<br>Regular readings of overall household power consumption.<br>This information is obtained with respect to households within the training group for periods of moderate and harsher weather (e.g., spring and summer, or alternatively, autumn and winter), and serves to train the supervised HVAC efficiency classification model. (The "regular readings of overall household power consumption" may be acquired every 15 min, that is, a rate of approximately 4 readings per hour.) |
| Operational household group | A group of households monitored after the training period. Such households provide at least some of the following data:<br>Information regarding the household profile parameters and residents' profile parameters;<br>Indoor temperature;<br>Outdoor temperature;<br>HVAC thermostat settings;<br>HVAC work mode;<br>HVAC compressor activation time; and<br>Overall household power consumption.<br>This information is obtained with respect to these households during periods of moderate weather (e.g., spring or fall), and is applied to the HVAC efficiency classification model to predict whether HVACs of these households are expected to efficiently reach the thermostat setting temperature during ensuing periods of harsher weather (e.g., summer or winter). |

-continued

| Term | Definition |
|---|---|
| Moderate weather period | Period of initial training and subsequent operational monitoring of the system, when HVACs generally reach and maintain thermostat setting temperatures (e.g., during spring or fall). A moderate weather period is a period when a typical homeowner would not notice that an HVAC is operating inefficiently, although an indication of inefficiency can be detected by the HVAC efficiency classification model. The training period, that is, the period of data collection, may range from several days to two or three months. |
| Harsher weather period | Period when HVACs that are malfunctioning may not efficiently reach the thermostat temperature settings (e.g., when cooling during summer, or heating during winter). During "harsher weather periods", data is acquired in order to label the training data collected during moderate weather periods. The training period, that is, the period of data collection, may range from several days to two or three months. |

FIG. 1 is a block diagram depicting a system 20 including client modules 200 for collecting data pertaining to specific households and HVAC systems, and for propagating this data to a server 100, according to some embodiments of the present invention;

The household client modules are configured to interface the server module 100 using any type of wired or wireless data communication standard (e.g. LAN, WAN, Wi-Fi, GSM, 3GPP, LTE, etc.), and to convey to the server 100 data pertaining to a specific household. This data includes at least one of the following types of data: the household properties, the household's overall power consumption (measured in 15 minute increments, typically by a smart meter), concurrent indoor and outdoor temperature measurements, and data relating to HVAC systems installed therein.

The household client modules 200 are comprised of at least one of the following submodules: an HVAC agent module 2100, a power consumption measurement module 2200, an environment measurement module 2300, a client configuration module 2400, and a client alert module 2500.

The HVAC agent module 2100 acquires data relating to at least one of HVAC compressor activation time; HVAC thermostat temperature settings; and HVAC mode of operation (i.e., cooling or heating).

The power consumption measurement module 2200 acquires power consumption readings of the household over time. According to some embodiments, the power consumption measurement module 2200 obtains household power consumption readings in a granularity of approximately every 15 minutes, from a smart household power meter.

The environment measurement module 2300 acquires concurrent indoor temperature and outdoor temperature readings.

The client configuration module 2400 provides an interface for acquiring household-specific parameters. These parameters may include at least one of the HVAC's properties (e.g. make, model, power rating); the household profile parameters (e.g. age, location and size); and residents' profile parameters (e.g. number of residents, household occupancy throughout the day).

The client alert module 2500 provides an interface for receiving alerts regarding suspected inefficiency of the HVAC, according to the logic explained further below.

The server 100 may be implemented in software or hardware or any combination thereof, configured to interface a plurality of household client modules 200, according to some embodiments. The server 100 obtains from each of the plurality of household client modules 200 data pertaining to each respective household, the data including at least one of the following data types:

HVAC compressor activation time (e.g., time periods of activation, or hourly or daily totals);
HVAC thermostat temperature settings;
HVAC mode of operation (i.e. cooling or heating);
Regular household power consumption readings (i.e., smart meter readings);
Indoor temperature;
Outdoor temperature;
HVAC properties (e.g., make, model, nominal power consumption, rated efficiency);
Household profile parameters (e.g., size, location, climate); and
Resident profile parameters.

According to some embodiments, the server module 100 also communicates with an administrative client module 300, which provides an administrative interface for system configuration, real-time alerts and production of historical reports.

The server module 100 includes submodules for analyzing the obtained data, identifying specific HVACs as efficient or inefficient, predicting the function of specific HVACs during periods of harsher weather conditions, and alerting against suspected conditions of inefficiency or malfunction. The submodules include at least one of the following:

A data accumulation module 1100
A data preprocessing module 1200
A training module 1300
A prediction module 1400

The data accumulation module 1100 accumulates real-time data from multiple private client modules, and stores it in a database for further processing.

The data preprocessing module 1200 applies various algorithms to produce the following explanatory features, also referred to as "derived parameters":

Household Efficiency Score
HVAC Linear Coefficient
Breakpoint Temperature Difference.

The training module 1300 applies machine learning algorithms to data from households within the training group, to produce an HVAC efficiency classification model, which distinguish between "efficient" and "inefficient" households, as elaborated further below.

The prediction module 1400 applies the HVAC efficiency classification model to households within the operational group of monitored households, predicting during moderate weather conditions whether HVACs installed therein will operate efficiently in harsher weather conditions.

Figure 2:
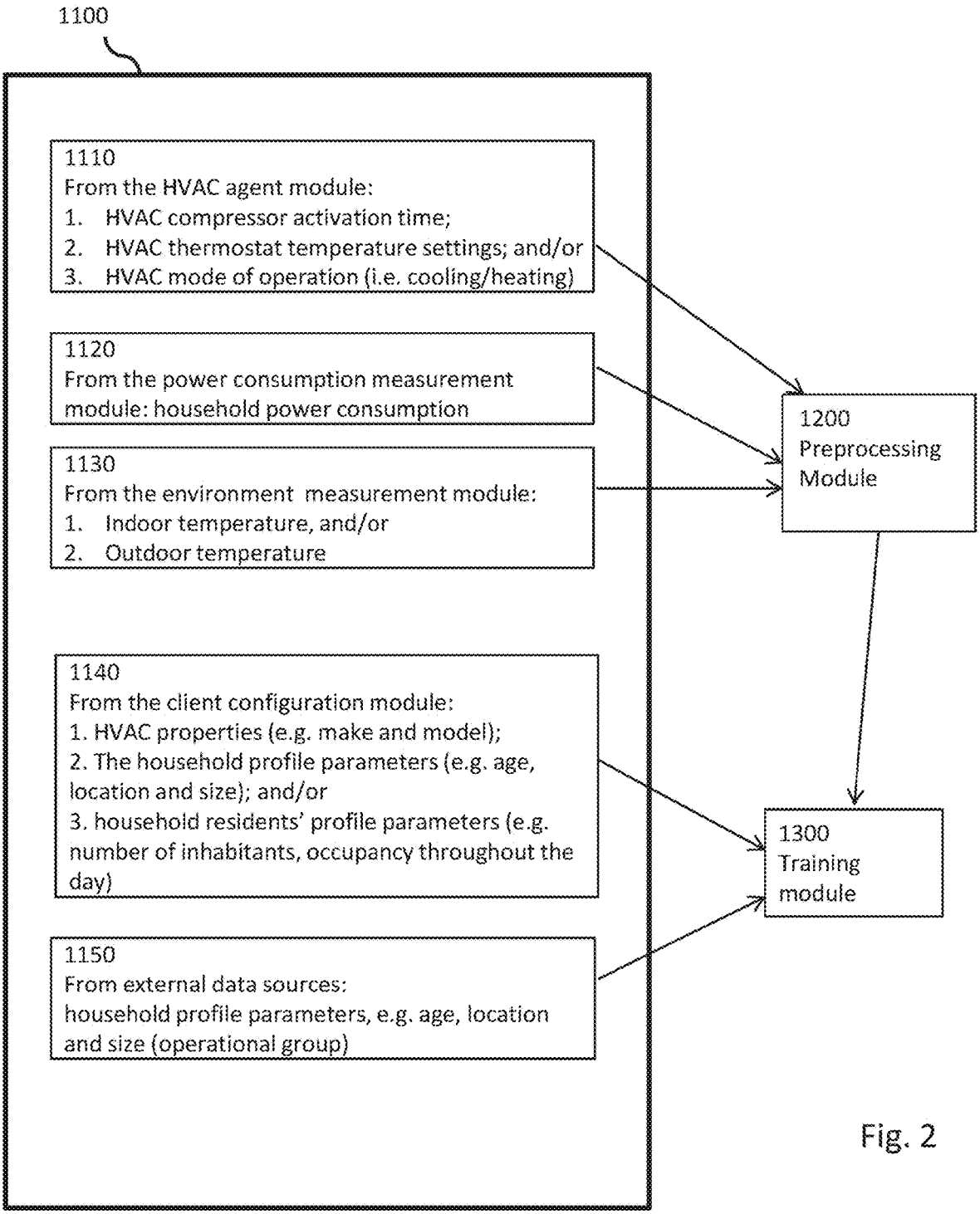
FIG. 2 is a flow diagram depicting the function of a data accumulation module, running within the server, to accumulate data pertaining to specific households in a training group and in an operational group, according to some embodiments of the present invention.

FIG. 2 is a flow diagram depicting the flow of data to the data accumulation module 1100 according to some embodiments of the present invention. The data accumulation module 1100 acquires and stores the following data.

Data acquired from the HVAC agent module 2100, at a step 1110, may include at least one of: HVAC compressor activation time, HVAC thermostat temperature settings; and HVAC mode of operation (i.e., cooling or heating).

Household power consumption over a time period for each household, within the household training group, may be acquired from the power consumption measurement module 2200, at a step 1120. According to some embodiments, the power consumption measurement module 2200 obtains household power consumption readings in a measurement granularity of one reading each 15 minutes from a smart household power meter.

Indoor and outdoor temperatures for each household, within the household training group, may be acquired from the environmental measurement module 2300, at a step 1130. According to one embodiment, the indoor and outdoor temperatures may be acquired by respective sensors, physically located at the household's location. According to another embodiment, the outdoor temperature may be acquired elsewhere, e.g. from online weather services.

Data collected at steps 1110, 1120, and 1130 are time-based, operational data. The data accumulation module 1100 subsequently transmits this data to the preprocessing module 1200, as described hereinbelow.

The data accumulation module 1100, at steps 1140 and 1150, also acquires non-operational data from the client configuration module 2400. This include HVAC properties, such as make, type, nominal power, age and HVAC ratings, which may including Energy Efficiency Rating (EER), Seasonal Energy Efficiency Rating (SEER), Coefficient of Performance (COP), and Heating Seasonal Performance Factor (HSPF). The client configuration module 2400 also provides household profile parameters (e.g., house size, type, location, age, geographic location and climate) and residents' profile parameters (e.g., number of residents, and household occupancy during the day). This information is comprehensively gathered for households of the training group. Households of the operational group may or may not provide this data, or may only provide a subset of the data.

Household profile parameters (e.g. age, location, size, type etc.) may be acquired from external sources (e.g. aerial or satellite photographs, online web sites, municipal databases, etc.), at a step 1150.

According to some embodiments of the present invention, the data accumulation module incorporates an interface to a database, facilitating the query of accumulated data by other components of the server module 1000. As indicated in FIG. 2, the operational data is provided to the training module 1300 after preprocessing by the preprocessing module 1200. The non-operational data is typically provided directly to the training module 1300. Subsequently, after training has been performed to generate the prediction module 1400, the same data flows of operational and non-operational data may be acquired by the data accumulation module 1100 and processed by the preprocessing module 1200 for use by the prediction module 1400 (as described below with respect to FIG. 8).

Figure 3:
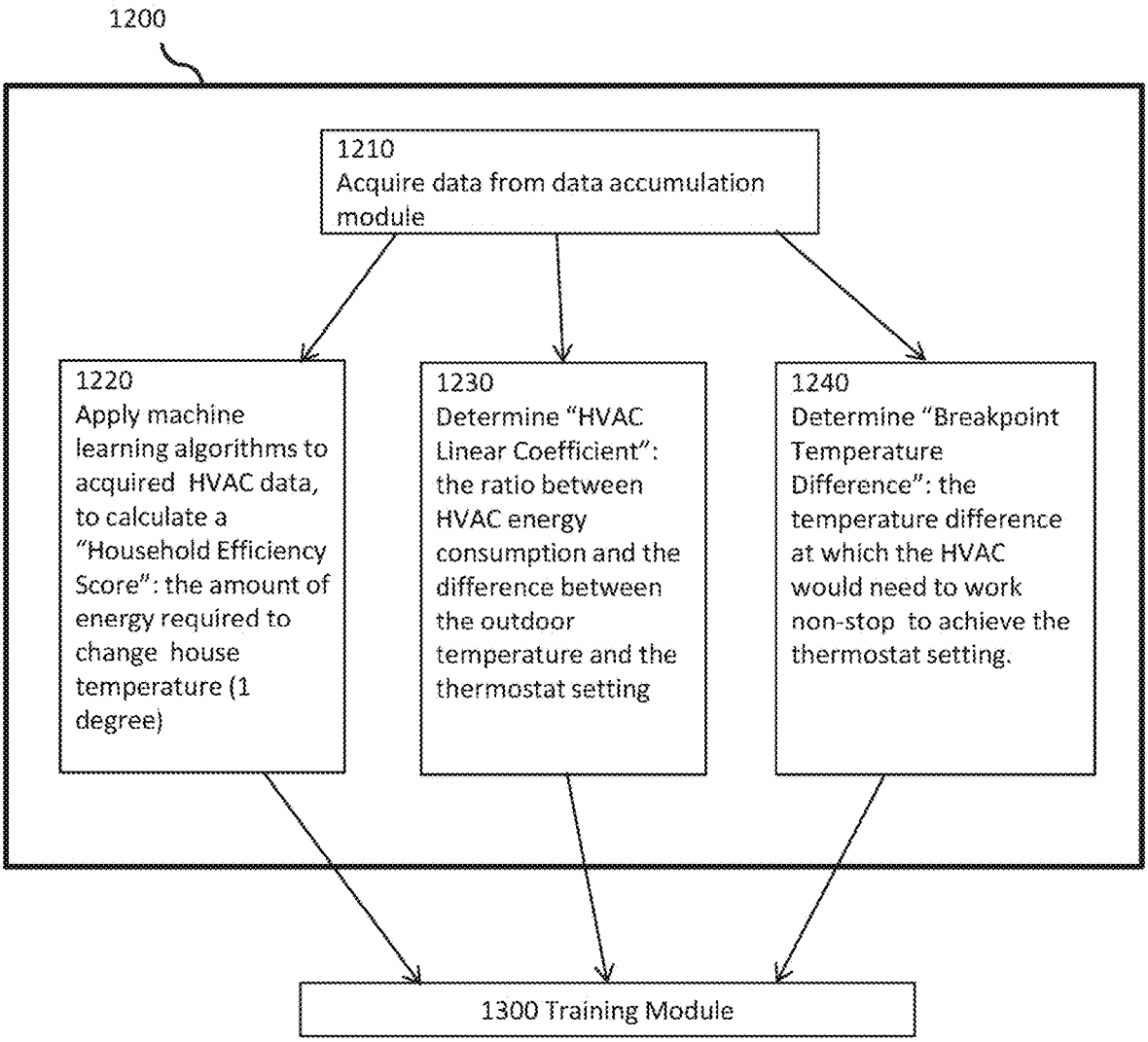
FIG. 3 is a flow diagram depicting the function of a data preprocessing module, running within the server, configured to produce household-specific explanatory features, according to some embodiments of the present invention.

FIG. 3 is a flow diagram depicting the function of the preprocessing module 1200, running within the server, configured to produce household-specific explanatory features, according to some embodiments of the present invention. These explanatory features, or "derived parameters" are then used by the training module 1300 to create a model for classifying household HVACs as "efficient" or "inefficient". Subsequently, after training has been performed to generate the prediction module 1400, the same derived parameters may be generated for use by the prediction module 1400

The preprocessing module 1200 acquires data pertaining to specific households, as obtained by the data accumulation module, at a step 1210. The preprocessing module 1200 may then apply machine learning algorithms to the data acquired for each household, to calculate a "Household Efficiency Score", i.e., the amount of energy required in order to cool-down or heat-up the house by 1 degree (e.g., Fahrenheit or Celsius), at a step 1220.

At a step 1230, the preprocessing module 1200 determines the "HVAC Linear Coefficient": the ratio between HVAC energy consumption and the difference between the outdoor temperature and the thermostat setting. This is the effect of the difference between the outdoor temperature and the setting of the thermostat temperature on the HVAC power consumption, within a period of HVAC activity.

The preprocessing module 1200 determines at a step 1240 the "Breakpoint Temperature Difference", i.e., the difference between the thermostat temperature setting and outdoor temperatures at which the HVAC would need to work without stop to achieve the thermostat temperature setting.

The derived parameters may be generated by preprocessing module 1200 from data that may include direct measurements of HVAC performance.

Figure 4A:
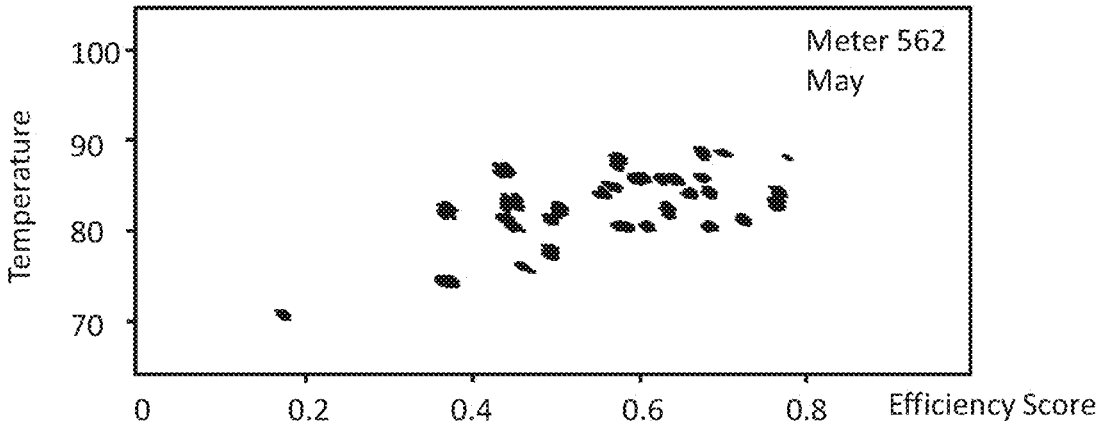
FIGS. 4A-4D are graphs of empirical measurements, depicting the derived parameter, "Daily Household Efficiency Score" for two individual households, as a function of temperature for multiple days of the two different training periods, a mild weather period and a harsher weather period.
Figure 4B:
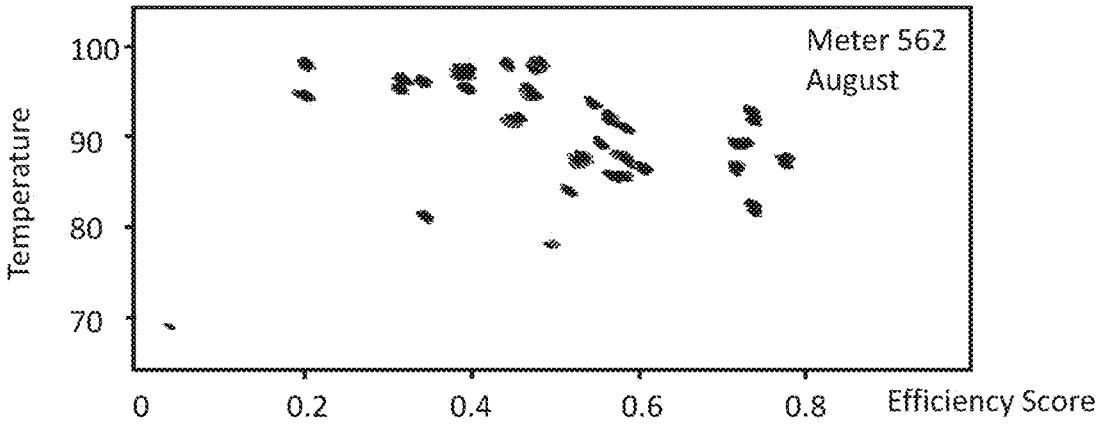
Figure 4C:
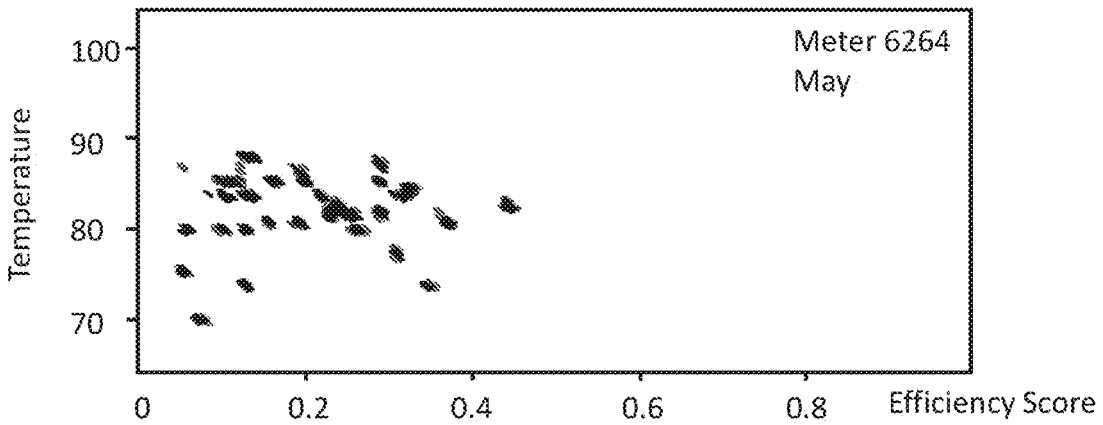
Figure 4D:
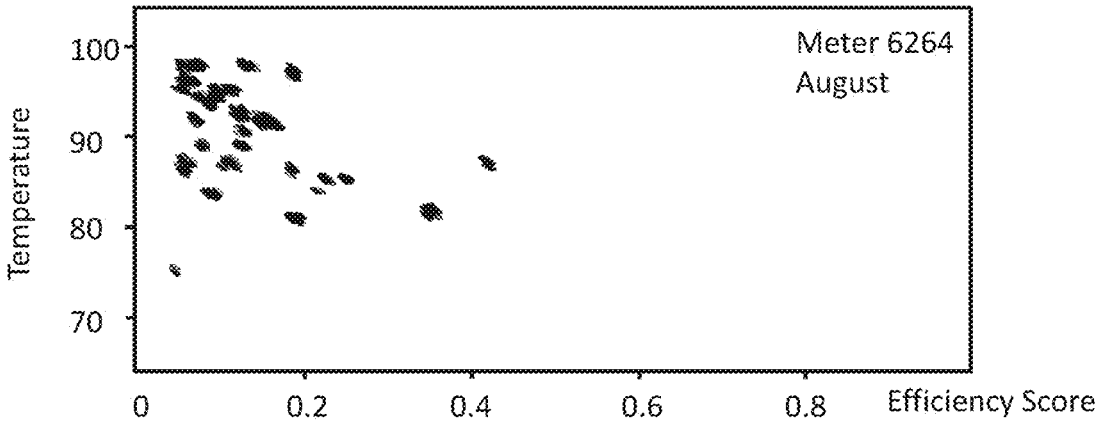

FIGS. 4A-4D show empirical graphs depicting the derived parameter, "Daily Household Efficiency Score" for two different individual households, as a function of temperature for multiple days of the two different training periods, a mild weather period (the month of May) and a harsher weather period (the month of August). FIGS. 4A and 4B depict a household in which the HVAC efficiency is normal. From the acquired data, the preprocessing module derives "Daily Household Efficiency Scores". These scores are relatively high on most days, regardless of the temperature. Similarly, FIGS. 4C and 4D depicts a household in which the efficiency is determined to be relatively low. From the acquired data, the preprocessing module derives "Daily Household Efficiency Scores" that are relatively low on most days, both during the mild weather period and subsequently during the harsher weather period.

Figure 5:
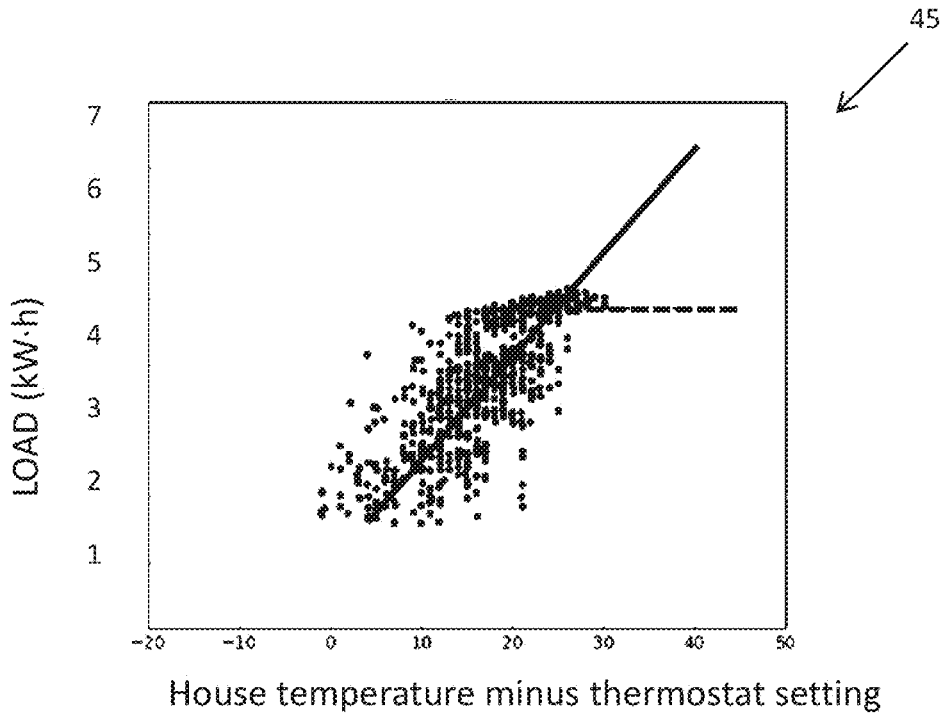
FIG. 5 is a graph of empirical measurements, depicting the dependence of the HVAC power consumption (energy consumption per period of HVAC activity) on the difference between the outdoor temperature and the thermostat setting, indicating how parameters "HVAC Linear Coefficient" and "Breakpoint Temperature Difference" are calculated.

FIG. 5 depicts a graph 45 of the dependence of HVAC power consumption (energy consumption per period of HVAC activity) on the difference between outdoor temperature and the thermostat temperature setting. The Y-axis is the HVAC hourly energy consumption in kilowatt-hours (KWH). The X-axis is the difference between the outdoor temperature and the thermostat settings (in degrees Fahrenheit). The solid line presents a linear approximation of the dependence. The inclination of the solid line is the HVAC Linear Coefficient, described above.

The broken line depicts the linear dependence of HVAC power consumption on the difference between the thermostat temperature setting and the outdoor temperature. It follows the same behavior as the solid line for minor temperature differences. At a certain point (around 23° F.), the broken line becomes horizontal. The inflection point is the graphical representation of the "Breakpoint Temperature Difference", described above, which is the point at which any further increase in temperature difference will no longer affect the HVAC power consumption, and the HVAC will not be able to efficiently reach the thermostat temperature setting.

Figure 6:
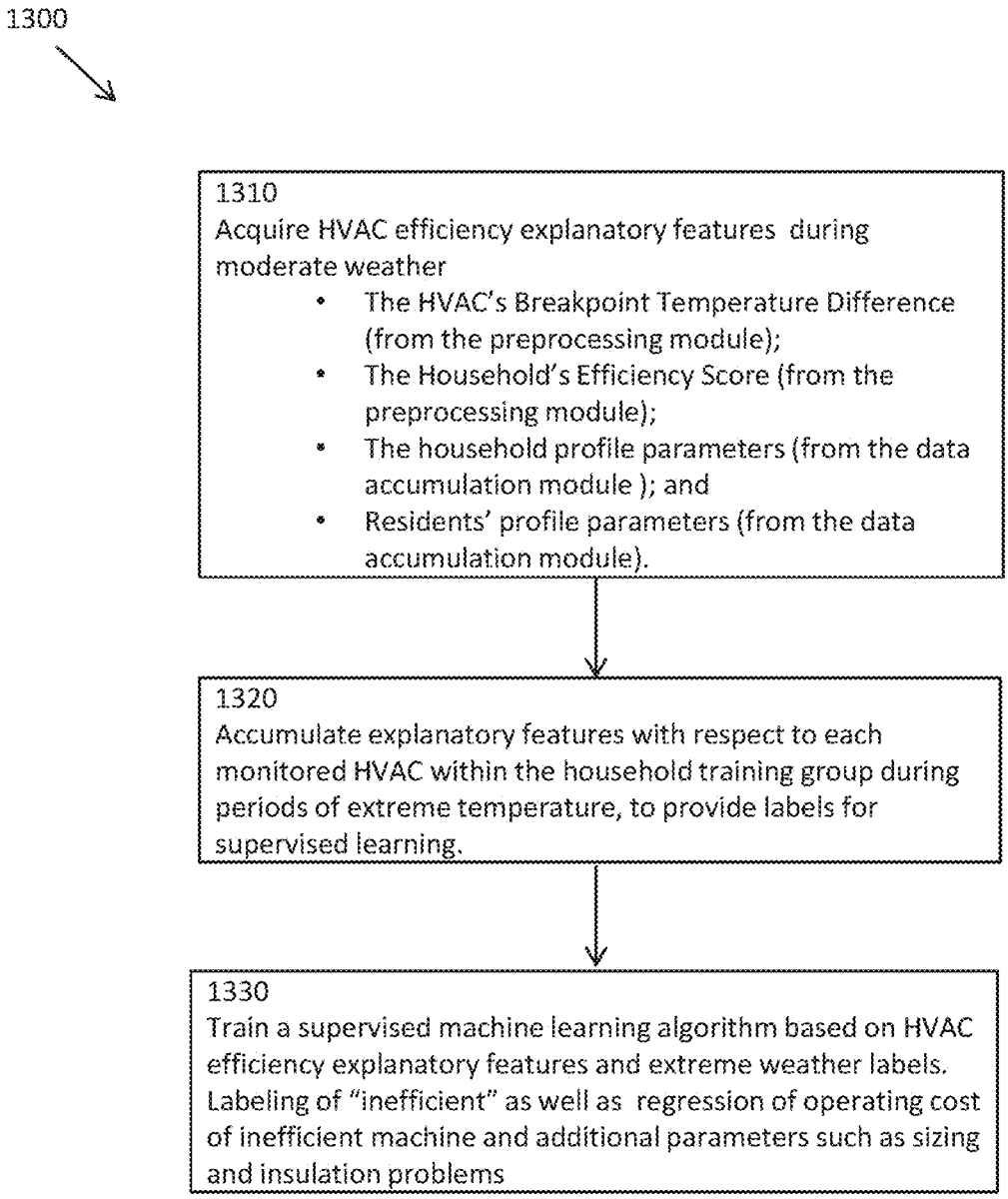
FIG. 6 is a flow diagram depicting the function of a training module, running within the server, to classify training group households according to an HVAC efficiency classification model, wherein households are classified as either "efficient" or "inefficient", i.e., whether an HVAC is predicted to efficiently reach thermostat settings during summer or winter periods, according to some embodiments of the present invention.

FIG. 6 is a flow diagram depicting the function of a training module, running within the server, to classify households by an HVAC efficiency classification model, predicting whether an HVAC would efficiently reach the thermostat settings during periods of harsher weather (e.g., cooling during summer time, or heating during winter time), according to some embodiments of the present invention. The HVAC efficiency classification is based on data collected during periods of moderate weather (spring or fall), labelled with results measured during harsher weather periods (respectively summer or winter). Labels classify household HVACs as either "efficient" or "inefficient", and may also include additional classifiers, such as whether the HVAC is malfunctioning, whether undersized or oversized, and whether additional parameters are preventing proper HVAC operation, such as insufficient insulation.

The training module 1300 accumulates at least part of the following data from each monitored HVAC within the household training group, at a step 1310:

- HVAC Linear Coefficient (from the preprocessing module);
- HVAC Breakpoint Temperature Difference (from the preprocessing module);
- Household Efficiency Score (from the preprocessing module);
- Household profile parameters (from the data accumulation module); and
- Resident profile parameters (from the data accumulation module).

The above parameters are also referred to hereinbelow as the HVAC efficiency explanatory features.

At a step 1320 the training module 1300 may acquire, during periods of harsher weather (e.g., summer or winter), additional data with respect to each monitored HVAC within the household training group. This data indicates whether the HVAC has efficiently reached the thermostat setting temperature, and thus serves as feedback for supervising the training of the HVAC efficiency classification model. For example, during a period of harsher weather, the labeling process may be set to determine that an HVAC is malfunctioning if it cannot reach a temperature of the thermostat setting on 25% of the days of the period, or during 25% of each day, or, as a further example, that the HVAC cannot reach within 2° F. of the desired thermostat setting for a period of over 2 hours.

Figure 7:
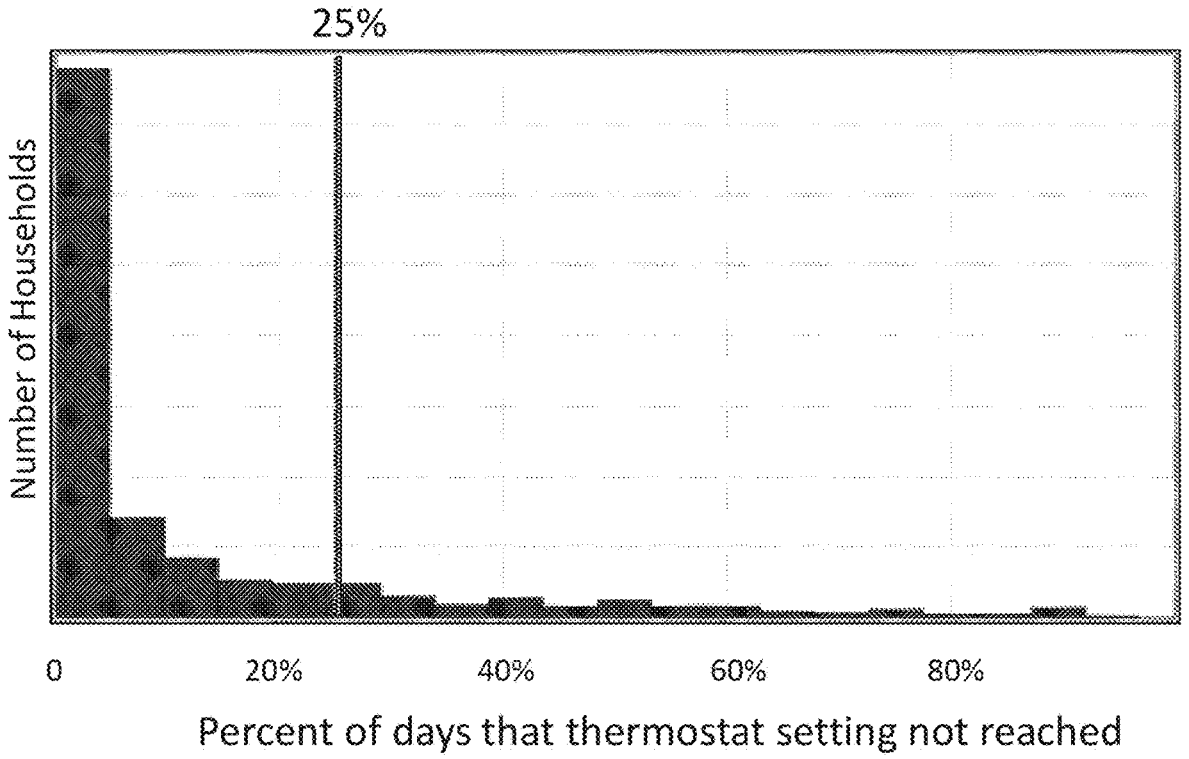
FIG. 7 is a graph of empirical measurements, depicting the distribution of the number of days/month of a harsh weather period during which household temperatures do not reach the thermostat setting, indicating that, for example, a cut-off of 25% may be set to indicate ineffective or inefficient HVACs.

Reference is made to FIG. 7, which is a graph of empirical measurements, depicting the distribution of the number of days/month of a harsher weather period during which household temperatures do not reach the thermostat setting, indicating that, for example, a cut-off of 25% may be set to label ineffective or inefficient HVACs.

Manual surveying of household HVAC operation HVAC can also be applied to distinguish the following conditions, which may also be used as classification labels:

- Low maintenance level: filters dirty
- Extreme comfort settings: household occupants chose a set temperature that is harder to reach
- Incompatible HVAC: HVAC capacity doesn't fit the space (undersized).
- Envelope problem: poor insulation causes temperature loss
- HVAC recognized as malfunctioning, for example, by technician report. In some cases, the system may also identify a sudden change in HVAC operation, indicating that the HVAC has been fixed.

Returning to FIG. 6, the training module 1300, at a step 1330, trains a supervised machine learning algorithm from the HVAC data accumulated during periods of moderate weather, e.g., fall or spring, and labeled according to operation during the corresponding winter or summer, to create an HVAC efficiency classification model. The training process may include generating additional derived parameters, in an aggregation process of "binning". For example, an additional derived parameter might be the distribution of monthly HVAC efficiency scores over different temperature bins, which would indicate HVAC responsiveness to temperature. Subsequently, the binning process is also applied in the operational prediction process. Training may also combine multiple machine learning techniques. For example, a predictive model may be created that blends by a weighted average a convolutional neural network along with a gradient boosted decision tree classifier. The goal is to predict when an HVAC will not be able reach a desired set temperature, within the near future (2-4 month ahead).

Figure 8:
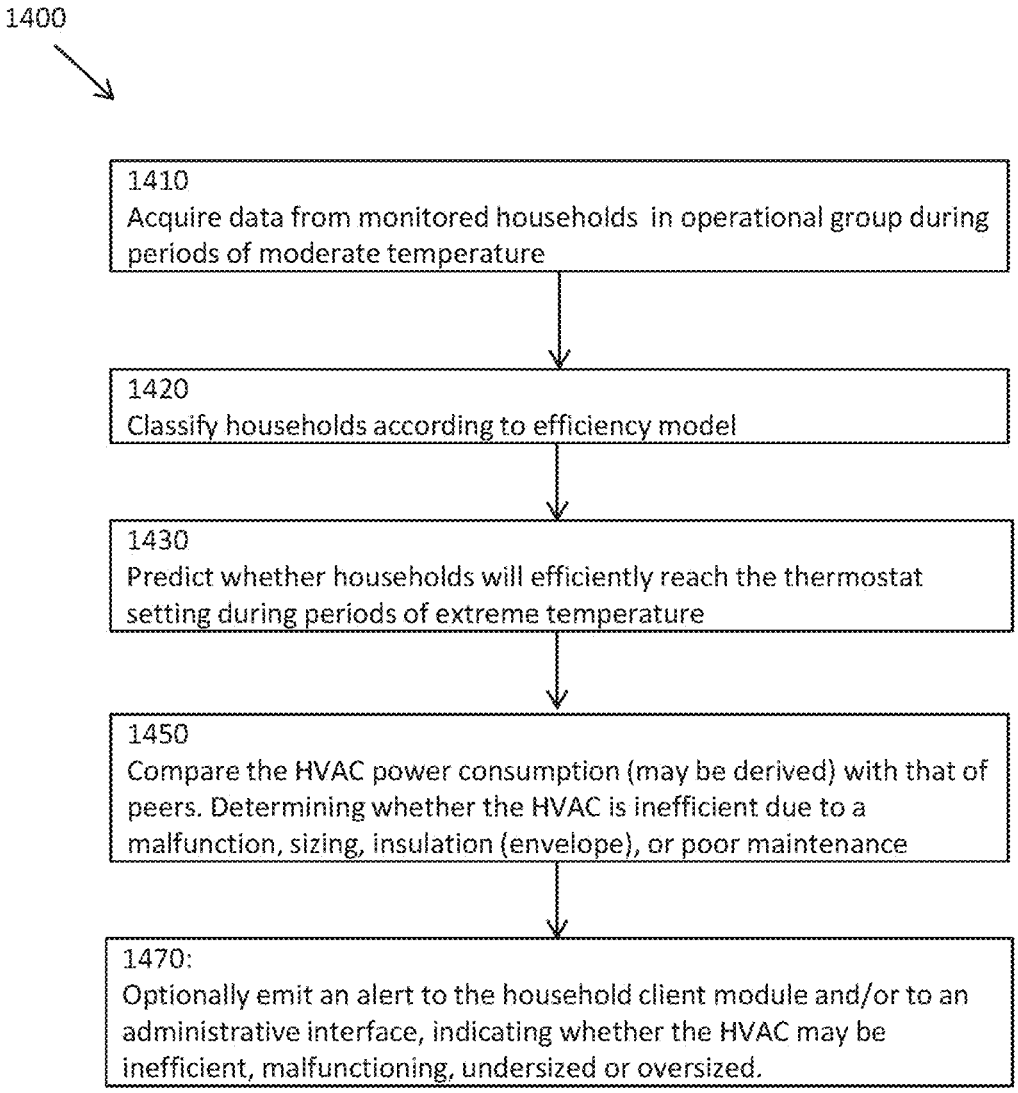
FIG. 8 is a flow diagram depicting the function of the prediction module 1400, running within the server 100, configured to apply the HVAC efficiency classification model to data from an operational group of households, according to some embodiments of the present invention.

FIG. 8 is a flow diagram depicting the function of the prediction module 1400, running within the server 100, configured to apply the HVAC efficiency classification model to data from an operational group of households, according to some embodiments of the present invention. The prediction module 1400 predicts the behavior of HVAC systems in periods of harsher weather (or extreme thermostat settings, that is, when the thermostat setting temperature is significantly different from the outside temperature), and may alert users of the predicted HVAC inefficiency or malfunction.

At a step 1410, the prediction module 1400 acquires data from monitored households in the operational group, during periods of moderate temperature.

At a step 1420, the prediction module 1400 classifies households within the operational group of monitored households, to associate each such household with either one of the two HVAC efficiency model classes: "efficient" or "inefficient".

Subsequently, at a step 1430, the prediction module 1400 may predict whether households of the operational group of households will efficiently reach the thermostat settings during periods of harsher weather.

At a step 1450, the prediction module 1400 examines households that have been classified as "inefficient". It compares the extracted HVAC power consumption with that of its peers, that is, households with similar HVAC profiles and resident profiles. The prediction module 1400 thus determines whether the HVAC may be inefficient due to a malfunction, or whether it is simply undersized or oversized in relation to the household's properties.

According to one embodiment, the prediction module 1400, at step 1470, may emit an alert to the household client module and/or to an administrative interface, indicating whether the HVAC is suspected as inefficient or malfunctioned.

The system of the present invention may include, according to certain embodiments of the invention, machine readable memory containing or otherwise storing a program of instructions which, when executed by the machine, implements some or all of the apparatus, methods, features and functionalities of the invention shown and described herein. Alternatively or in addition, the apparatus of the present invention may include, according to certain embodiments of the invention, a program which may be written in any conventional programming language, and optionally a machine for executing the program such as but not limited to a general purpose computer which may optionally be configured or activated in accordance with the teachings of the present invention. Any of the teachings incorporated herein may wherever suitable operate on signals representative of physical objects or substances.

It is to be understood that throughout the specification terms such as, "processing", "computing", "estimating", "selecting", "ranking", "grading", "calculating", "determining", "generating", "reassessing", "classifying", "generating", "producing", "stereo-matching", "registering", "detecting", "associating", "superimposing", "obtaining" or the like, refer to the action and/or processes of a computer or computing system, or processor or similar electronic computing device, that manipulate and/or transform data that may be electronic quantities within the computing system's memory into other data similarly represented as physical quantities within the computing system's memory. The term "computer" should be broadly construed to cover any kind of electronic device with data processing capabilities, including, by way of non-limiting example, personal computers, servers, computing system, communication devices, processors (e.g. digital signal processor (DSP), microcontrollers, field programmable gate array (FPGA), application specific integrated circuit (ASIC), etc.) and other electronic computing devices.

It is appreciated that software components of the present invention including programs and data may be implemented in ROM (read only memory) form including CD-ROMs, EPROMs and EEPROMs, or may be stored in any other suitable typically non-transitory computer-readable medium such as but not limited to disks of various kinds, cards of various kinds and RAMs. Components described herein as software may, alternatively, be implemented wholly or partly in hardware.

Included in the scope of the present invention, inter alia, are electromagnetic signals carrying computer-readable instructions for performing any or all of the steps of any of the methods shown and described herein, in any suitable order; machine-readable instructions for performing any or all of the steps of any of the methods shown and described herein, in any suitable order; program storage devices readable by machine, tangibly embodying a program of instructions executable by the machine to perform any or all of the steps of any of the methods shown and described herein, in any suitable order; a computer program product comprising a computer useable medium having computer readable program code, such as executable code, having embodied therein, and/or including computer readable program code for performing, any or all of the steps of any of the methods shown and described herein, in any suitable order; any technical effects brought about by any or all of the steps of any of the methods shown and described herein, when performed in any suitable order; any suitable apparatus or device or combination of such, programmed to perform, alone or in combination, any or all of the steps of any of the methods shown and described herein, in any suitable order; electronic devices each including a processor and a cooperating input device and/or output device and operative to perform in software any steps shown and described herein; a program pre-stored e.g. in memory or on an information network such as the internet, before or after being downloaded, which embodies any or all of the steps of any of the methods shown and described herein, in any suitable order, and the method of uploading or downloading such, and a system including server/s and/or client/s for using such; and hardware which performs any or all of the steps of any of the methods shown and described herein, in any suitable order, either alone or in conjunction with software. Any computer-readable or machine-readable media described herein is intended to include non-transitory computer- or machine-readable media.

Any computations or other forms of analysis described herein may be performed by a suitable computerized method. Any step described herein may be computer-implemented. The invention shown and described herein may include (a) using a computerized method to identify a solution to any of the problems or for any of the objectives described herein, the solution optionally include at least one of a decision, an action, a product, a service or any other information described herein that impacts, in a positive manner, a problem or objectives described herein; and (b) outputting the solution.

The scope of the present invention is not limited to structures and functions specifically described herein and is also intended to include devices which have the capacity to yield a structure, or perform a function, described herein, such that even though users of the device may not use the capacity, they are, if they so desire, able to modify the device to obtain the structure or function.

The invention claimed is:

1. A method for monitoring a plurality of heating, ventilation, and air conditioning (HVAC) systems and predicting inefficient HVAC operation, implemented by one or more processors operatively coupled to a non-transitory computer readable storage device, on which are stored modules of instruction code that when executed cause the one or more processors to perform the following steps:

during a first period of weather that permits relatively low energy consumption of the HVAC system, obtaining first training data for HVACs in a training set of households;

during a subsequent period of weather that requires relatively high energy consumption of the HVAC system, obtaining second training data for HVACs in the training set of households;

generating classification labels of the household locations of the training set according to the second training data;

applying the first training data and the classification labels to generate an HVAC classification model predictive of inefficiency during periods of weather conditions that require relatively high energy consumption of the HVAC system;

during a second period of weather that permits relatively low energy consumption of the HVAC system, obtaining operational data pertaining to HVACs in an operational set of households; and applying the HVAC classification model to predict inefficiency of HVACs, during a second subsequent period of weather that requires relatively high energy consumption of the HVAC system, at individual households in the operational set.

2. The method of claim 1, wherein the first, second, and operational data include: smart meter readings of overall household electricity consumption, readings of HVAC activation time, readings of HVAC thermostat settings, readings of indoor temperatures, and readings of outdoor temperature.

3. The method of claim 2, wherein the first, second, and operational data include at least one additional type of data from a set of data types including: HVAC mode of operation readings, HVAC physical properties, household profile parameters, and resident profile parameters.

4. The method of claim 3, wherein the HVAC mode of operation is one of cooling or heating.

5. The method of claim 3, wherein the HVAC physical properties include one or more of make, model, nominal power consumption, and rated efficiency.

6. The method of claim 3, wherein the household profile parameters include at least one of: house type, size, age, geographic location, regional climate, orientation and level.

7. The method of claim 3, wherein the resident profile parameters include at least one of: number of residents, relationship of residents, and hours during which they occupy the residence.

8. The method of claim 1, wherein the first and second training data indicate a percentage of HVAC operating time that a thermostat setting temperature is not reached.

9. The method of claim 1, wherein applying the HVAC classification model further comprises generating a prediction of whether the inefficiency is due to HVAC malfunction, faulty maintenance, extreme thermostat settings, poor insulation, or poor sizing.

10. The method of claim 1, wherein applying the HVAC classification model further comprises generating an alert when the model predicts an HVAC inefficiency.

11. The method of claim 1, wherein the step of applying the first training data and the classification labels to generate an HVAC classification model predictive of inefficiency during periods of weather conditions that require relatively high energy consumption of the HVAC system comprises preprocessing the first and second training data to generate derived parameters from each respective type of data, wherein the derived parameters include one or more of a "household efficiency score", an "HVAC linear coefficient", and a "breakpoint temperature difference".

12. The method of claim 1, wherein the HVAC classification model blends, by a weighted average, a convolutional neural network along with a gradient boosted decision tree classifier.

13. The method of claim 1, wherein the first period of weather that permits relatively low energy consumption of the HVAC system is a first spring period of multiple days, wherein the subsequent period of weather that requires relatively high energy consumption of the HVAC system is a first summer period of multiple days following the first spring period, wherein the second period of weather that permits relatively low energy consumption of the HVAC system is a second spring period of multiple days, and wherein the HVAC classification model predicts from operational data acquired during the second spring period an inability to efficiently cool a household during a summer immediately following the second spring period.

14. The method of claim 1, wherein the first period of weather that permits relatively low energy consumption of the HVAC system is a first fall period of multiple days, wherein the subsequent period of weather that requires relatively high energy consumption of the HVAC system is a first winter period of multiple days immediately following the first fall period, wherein the second period of weather that permits relatively low energy consumption of the HVAC system is a second fall period of multiple days, and wherein the HVAC classification model predicts from operational data acquired during the second fall period an inability to efficiently warm a household during a winter immediately following the second spring period.

* * * * *